US010302076B2

(12) United States Patent
Hays et al.

(10) Patent No.: US 10,302,076 B2
(45) **Date of Patent: *May 28, 2019**

(54) PERISTALTIC PUMP

(71) Applicant: Orbis Wheels, Inc., Mill Valley, CA (US)

(72) Inventors: Marcus G. Hays, San Rafael, CA (US); Scott Streeter, Santa Rosa, CA (US); Benjamin Lorimore, Portland, OR (US)

(73) Assignee: ORBIS WHEELS, INC., Mill Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/865,068

(22) Filed: Jan. 8, 2018

(65) Prior Publication Data

US 2018/0142682 A1 May 24, 2018

Related U.S. Application Data

(63) Continuation of application No. 15/215,477, filed on Jul. 20, 2016, now Pat. No. 9,869,309, which is a (Continued)

(51) Int. Cl.
*F04B 43/12* (2006.01)
*F04B 43/09* (2006.01)
(Continued)

(52) U.S. Cl.
CPC ..... *F04B 43/1261* (2013.01); *F04B 23/02* (2013.01); *F04B 43/0072* (2013.01); *F04B 43/09* (2013.01); *F04B 53/16* (2013.01)

(58) Field of Classification Search
CPC .. F04B 43/12; F04B 43/1214; F04B 43/1276; F04B 43/1292; F04B 43/1215
See application file for complete search history.

(56) References Cited

U.S. PATENT DOCUMENTS 2,987,004 A 6/1961 Murray
4,441,867 A * 4/1984 Berelson ..... F04B 43/1292 417/475

(Continued)

OTHER PUBLICATIONS

International Search Report dated Jul. 21, 2016 as received in Application No. PCT/US2016/029398.

(Continued)

*Primary Examiner* — Patrick Hamo
(74) *Attorney, Agent, or Firm* — Maschoff Brennan

(57) ABSTRACT

The present disclosure may relate to a pump including a centerless rim, a first roller guide shaped to roll along the centerless rim such that as the first roller guide is rotated, friction between the first roller guide and the centerless rim causes a corresponding rotation of the centerless rim. The pump may also include a second roller guide shaped to roll along the centerless rim, and a plurality of peristaltic rollers coupled to the centerless rim. The pump may additionally include a tube housing disposed proximate the plurality of peristaltic rollers, and a tube disposed between the tube housing and the peristaltic rollers such that as the centerless rim is rotated, the peristaltic rollers compress the tube against the tube housing to create negative pressure within the tube.

20 Claims, 7 Drawing Sheets

Related U.S. Application Data continuation of application No. 15/138,967, filed on Apr. 26, 2016, now Pat. No. 9,869,308.

(51) Int. Cl.

| | |
|---|---|
| ***F04B 53/16*** | (2006.01) |
| ***F04B 23/02*** | (2006.01) |
| ***F04B 43/00*** | (2006.01) |

(56) References Cited

U.S. PATENT DOCUMENTS

| | | | | | |
|---|---|---|---|---|---|
| 4,878,622 | A | | 11/1989 | Jamison et al. | |
| 5,249,937 | A | * | 10/1993 | Aubert | F04B 43/1253 417/475 |
| 5,266,013 | A | * | 11/1993 | Aubert | A61M 5/1413 417/360 |
| 5,586,872 | A | * | 12/1996 | Skobelev | F04B 43/1253 417/477.8 |
| 7,771,179 | B2 | | 8/2010 | Kubota et al. | |
| 8,790,096 | B2 | | 7/2014 | Sorensen | |
| 9,869,308 | B2 | * | 1/2018 | Hays | F04B 43/1261 |
| 9,869,309 | B2 | * | 1/2018 | Hays | F04B 43/1261 |
| 2013/0071270 | A1 | | 3/2013 | Zupp et al. | |

OTHER PUBLICATIONS

Written Opinion of the International Searching Authority dated Jul. 21, 2016 as received in Application No. PCT/US2016/029398.

* cited by examiner

PERISTALTIC PUMP

CROSS-REFERENCE TO RELATED APPLICATION

This application is a continuation of U.S. application Ser. No. 15/138,967 filed on Apr. 26, 2016, and U.S. application Ser. No. 15/215,477 filed on Jul. 20, 2016, both of which are incorporated herein by reference in their entireties.

FIELD

The embodiments discussed in the present disclosure relate to a centerless pump.

BACKGROUND

Some pumps have moving parts, support members, or other components in the middle of the pump. One such type of pump includes peristaltic pumps. In a peristaltic pump, a series of rollers compress a tube to force fluid (e.g., a liquid or a gas) through the tube as the rollers progress along different parts of the tube.

The subject matter claimed in the present disclosure is not limited to embodiments that solve any disadvantages or that operate only in environments such as those described above. Rather, this background is only provided to illustrate one example technology area where some embodiments described may be practiced.

SUMMARY

One or more embodiments of the present disclosure may include a pump that includes a centerless rim, a first roller guide shaped to roll along the centerless rim such that as the first roller guide is rotated, friction between the first roller guide and the centerless rim causes a corresponding rotation of the centerless rim. The pump may also include a second roller guide shaped to roll along the centerless rim, and a plurality of peristaltic rollers coupled to the centerless rim. The pump may additionally include a tube housing disposed proximate the plurality of peristaltic rollers, and a tube disposed between the tube housing and the peristaltic rollers such that as the centerless rim is rotated, the peristaltic rollers compress the tube against the tube housing to create negative pressure within the tube.

The object and advantages of the present disclosure will be realized and achieved at least by the elements, features, and combinations particularly pointed out in the claims.

It is to be understood that both the foregoing general description and the following detailed description are given as examples and are explanatory and are not restrictive of the invention, as claimed.

BRIEF DESCRIPTION OF THE DRAWINGS

Example embodiments will be described and explained with additional specificity and detail through the use of the accompanying drawings in which.

DESCRIPTION OF EMBODIMENTS

The present disclosure relates to a centerless pump. In some embodiments, such a pump may include a centerless rim with one or more peristaltic rollers coupled to the centerless rim. Rotation of the centerless rim may rotate the peristaltic rollers to compress a tube against a tube housing, thus operating in a peristaltic fashion. For example, compression of the tube against the tube housing and the rolling progression of the peristaltic rollers may create a negative pressure within the tube to draw material into the tube behind the peristaltic rollers. Additionally, for material within the tube, the rolling progression of the peristaltic rollers may force material in front of the peristaltic rollers out of the tube.

The centerless pump may additionally include a first roller guide shaped such that the centerless rim rolls along the first roller guide as the centerless rim is rotated. Because of static friction between the centerless rim and the first roller guide, rotation of the first roller guide may result in a corresponding rotation of the centerless rim, thereby rotating the peristaltic rollers. The first roller guide may be driven by manual power (e.g., a lever arm) or by motive power (e.g., a motor). The centerless pump may additionally include one or more other roller guides to support or otherwise direct the rotational motion of the centerless rim. The centerless pump may have a void of material in the middle of the centerless rim, although a point referred to as the "center" may be referenced for ease in discussing operation, relative positions, etc. of the present disclosure. In some embodiments, the void formed in the centerless pump may be used to house a reservoir of material (e.g., fluid to be pumped by the centerless pump) or a battery, motor, or other components of the centerless pump.

Embodiments of the present disclosure are explained with reference to the accompanying drawings.

Figure 1A:
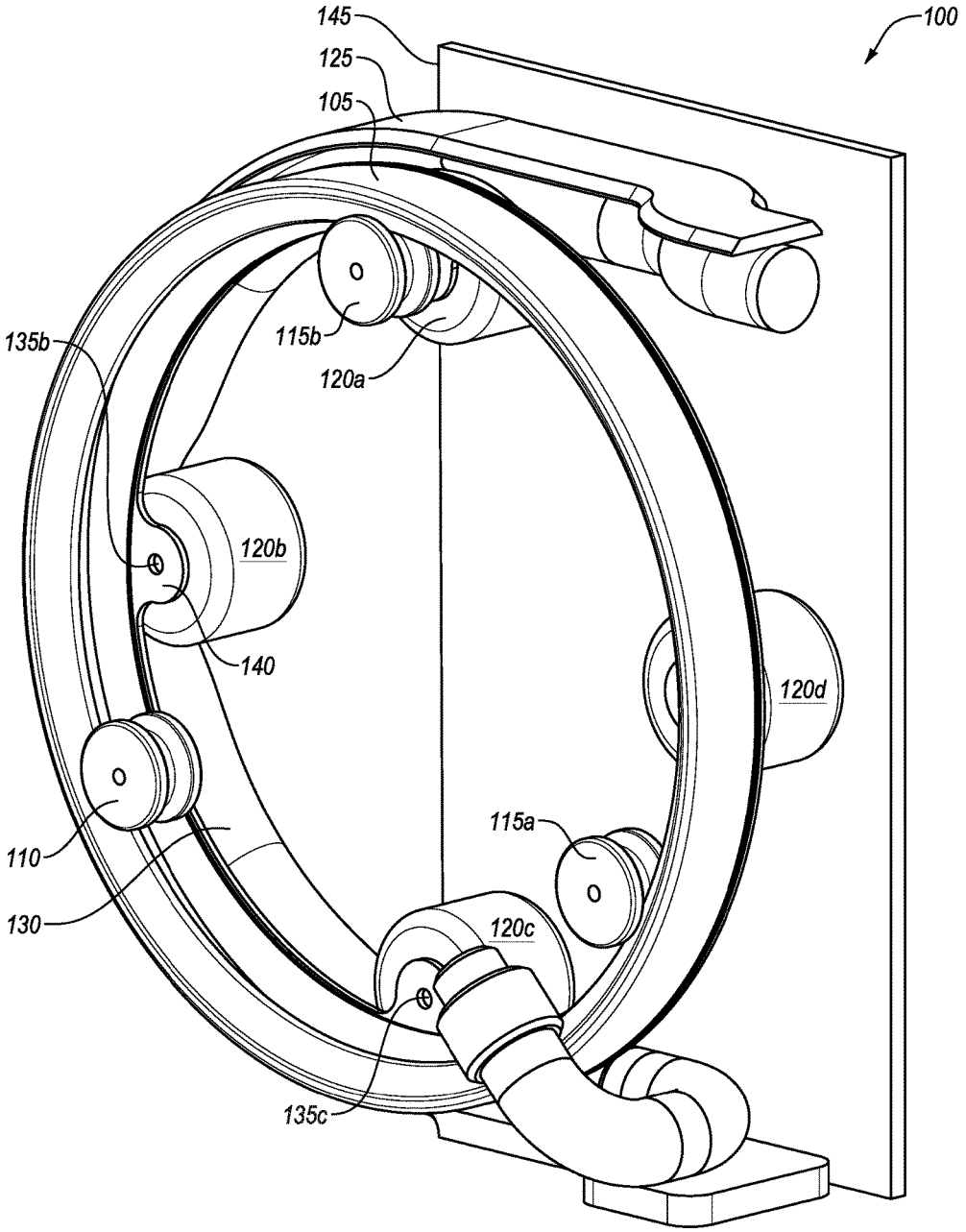
FIG. 1A illustrates a first perspective view of an example centerless pump.
Figure 1B:
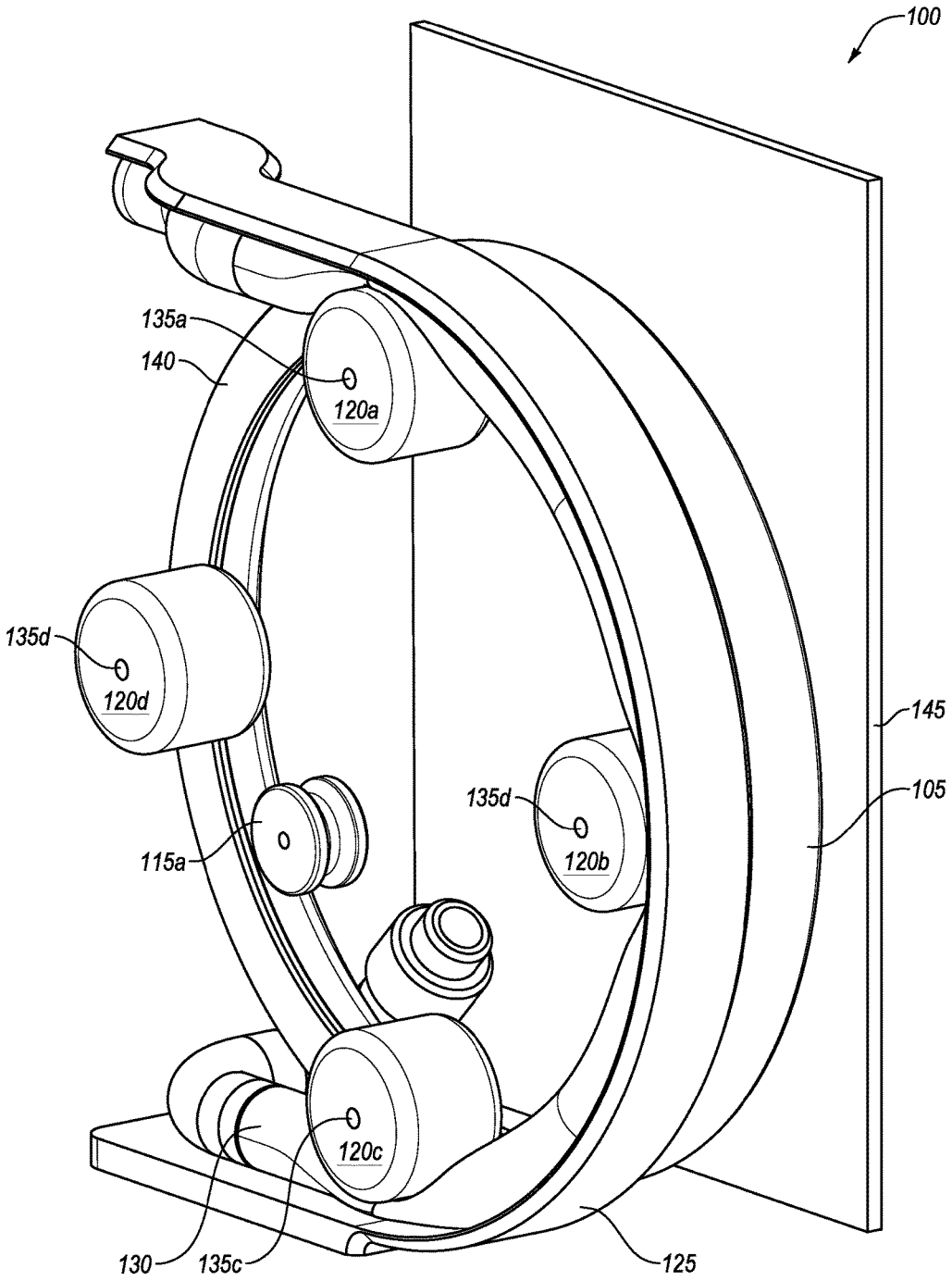
FIG. 1B illustrates a second perspective view of the example centerless pump of FIG. 1A.

FIGS. 1A and 1B illustrate a first and a second perspective view (respectively) of the same example centerless pump 100 viewed from the first and second perspective views, in accordance with one or more embodiments of the present disclosure. The centerless pump 100 may include a centerless rim 105 and a first roller guide 110 (viewable in FIG. 1A) shaped and configured such that the centerless rim 105 rolls along the first roller guide 110 as the centerless rim 110 rotates. Because of static friction between the first roller guide 110 and the centerless rim 105, rotation of the first roller guide 110 may cause a corresponding rotation of the centerless rim 105 as the centerless rim 105 rolls along first roller guide 110. For example, static friction between the first roller guide 110 and the centerless rim 105 causes the first roller guide 110 to drive the centerless rim 105 as the first roller guide 110 rotates. The centerless rim 105 may be suspended via the first roller guide 110 and one or more other roller guides 115 (e.g., a second roller guide 115*a* and a third roller guide 115*b*). As the centerless rim 105 is suspended and the first roller guide 110 is rotated, the centerless rim 105 may rotate about a center point of the centerless rim 105 in a plane that includes the first roller guide 110 and the second and third roller guides 115*a* and 115*b*. In these and other embodiments, the first roller guide 110 rolling along the centerless rim 105 may cause the centerless rim 105 to rotate around the center point of the centerless rim 105.

In some embodiments, the first roller guide 110 and/or the second and third roller guides 115*a* and 115*b* may be supported by a housing 145 or casing of the centerless pump 100. For example, the housing 145 may function as an exoskeleton plate for the centerless rim 105, the first roller guide 110, and the second and third roller guides 115*a* and 115*b*. In particular, an axle of the first roller guide 110 may be coupled to the housing 145 such that the first roller guide 110 may not move with respect to the housing 145 except to rotate about the axle while the centerless rim 105 rotates about its center point. As another example, an axle of the second and/or third roller guides 115*a* and 115*b* may be fixedly coupled to the housing 145 such that the second and/or third roller guides 115*a* and 115*b* may not move with respect to the housing 145 except to rotate freely about the axle. In these and other embodiments, one end or both ends of an axle may be fixedly coupled to the housing 145.

In some embodiments, the placement of the first roller guide 110 and/or the second and third roller guides 115*a* and 115*b* with respect to the housing 145 may define, restrict, guide, or otherwise control the rotational path of the centerless rim 105 within the housing 145. Stated another way, the first roller guide 110 may be caused to rotate, and because the first roller guide 110 and/or the second and third roller guides 115*a* and 115*b* are fixedly coupled to the housing 145, the centerless rim 105 may rotate about the center point of the centerless rim 105 while rolling along the first roller guide 110 and the second and third roller guides 115*a* and 115*b*. In some embodiments, the centerless rim 105 may rotate without contacting any component of the housing 145.

A profile of the centerless rim 105 may match a profile of the first roller guide 110. For example, if the centerless rim 105 has a concave shape, the first roller guide 110 may have a corresponding convex shape. The profile may be selected to provide adequate friction (e.g., to avoid slippage) between the centerless rim 105 and the first roller guide 110. Additionally or alternatively, the profile may be selected to provide support or physical path guidance to the rotation of the centerless rim 105. In some embodiments, the second and third roller guides 115*a* and 115*b* may have the same or a similar profile to the first roller guide 110.

In some embodiments, the first roller guide 110 may be driven via manual power drive mechanism or motive power drive mechanism. For example, the first roller guide 110 may be coupled to a crank, lever, or other manual mechanism by which a user may cause the first roller guide 110 to rotate to operate the centerless pump 100. As another example, the first roller guide 110 may be coupled to a motor to rotate the first roller guide 110. In these and other embodiments, gears, gearboxes, etc. may be coupled between the drive mechanism and the first roller guide 110. For example, one or more planetary gears may be disposed between the drive mechanism and the first roller guide 110. In these and other embodiments, a gearing ratio between the drive mechanism and the first roller guide may include approximately 5:1 to 1:5, 1:1 to 1:5, 5:1 to 1:1, 1:1 to 1:3, or 1:1 to 1:1.5.

In some embodiments, the first roller guide 110 may be coupled to a drive mechanism to drive or otherwise rotate the first roller guide 110. For example, the first roller guide 110 may be coupled to a crank, lever, or other manual mechanism by which a user may cause the first roller guide 110 to rotate to operate the centerless pump 100 manually. As another example, the first roller guide 110 may be coupled to a motor to drive the first roller guide 110. In these and other embodiments, gears, gearboxes, etc. may be coupled between the drive mechanism and the first roller guide 110. For example, one or more planetary gears may be disposed between the drive mechanism and the first roller guide 110. In these and other embodiments, a gearing ratio between the drive mechanism and the first roller guide may include approximately 5:1 to 1:5, 1:1 to 1:5, 5:1 to 1:1, 1:1 to 1:3, or 1:1 to 1:1.5.

In some embodiments, the first roller guide 110 may include keys, teeth, or other features to engage or otherwise lock the first roller guide 110 to an axle or other component of the drive mechanism. Using the keys, teeth, or other features, when the axle or other component of the drive mechanism is rotated, the first roller guide 110 may also rotate. An example of such a feature may be illustrated and/or explained with reference to FIGS. 5A and 5B.

In some embodiments, either or both of the second or third roller guides 115*a* and 115*b* may be driven in addition to the first roller guide 110 being driven. For example, in some embodiments, the first roller guide 110 and the second roller guide 115*a* may be driven. In these or other embodiments, the first roller guide 110, the second roller guide 115*a* and the third roller guide 115*b* may all be driven.

The first roller guide 110 and the second and third roller guides 115*a* and 115*b* may be disposed at various locations around the centerless pump. For example, analogizing the centerless rim 105 of FIGS. 1A and 1B to a clock face, the first roller guide 110 may be disposed between a six o'clock and a three o'clock position, the second roller guide 115*a* may be disposed between a six o'clock and a nine o'clock position, and the third roller guide 115*b* may be disposed between a nine o'clock and a three o'clock position. As illustrated in FIGS. 1A and 1B, the first roller guide 110 may be disposed at a four o'clock position, the second roller guide 115*a* may be disposed at an eight o'clock position, and the third roller guide 115*b* may disposed at a twelve o'clock position. In some embodiments, the roller guides 110, 115*a*, and 115*b* may be evenly distributed about the centerless rim 105.

One or more peristaltic rollers 120 (e.g., the peristaltic rollers 120*a*-120*d*) may be coupled to the centerless rim 105. The peristaltic rollers 120 may be coupled to the centerless rim 105 such that as the centerless rim 105 rotates, the peristaltic rollers 120*a*-120*d* may follow the trajectory of rotation of the centerless rim 105, tracing a generally circular path. For example, the peristaltic rollers 120*a*-120*d* may be bolted or otherwise coupled to the centerless rim 105 via an axle such that the peristaltic rollers may rotate about the axle as they follow the trajectory of rotation of the centerless rim 105. In these and other embodiments, because the peristaltic roller 120 is able to rotate around the axle, static friction between the peristaltic roller 120 and the tube 130 may cause the peristaltic roller 120 to rotate about the axle 135 as it moves along the tube 130 during rotation of the centerless rim 105 creating a pumping action in the tube 130. Such pumping action may be caused by the peristaltic rollers creating negative pressure in the tube 130 behind the peristaltic roller 120 and/or by the peristaltic roller 120 forcing material in the tube out of the tube 130.

A tube housing 125 and a tube 130 may be disposed proximate the centerless rim 105 and the peristaltic rollers 120*a*-120*d*. In particular, the tube 130 may be disposed between the tube housing 125 and the peristaltic rollers 120. The tube housing 125 may have a shape generally matching a portion of the circular trajectory traced by the peristaltic rollers 120. The tube 130 may be disposed proximate the tube housing 125 and the peristaltic rollers 120 such that as the centerless rim 105 is rotated causing the peristaltic rollers 120 to follow the circular path, the peristaltic rollers 120 may compress the tube 130 against the tube housing 125. By compressing the tube 130 and progressing along the circular path, the peristaltic rollers 120 may generate a negative pressure within the tube 130 behind the peristaltic rollers 120. Additionally or alternatively, the peristaltic rollers 120 may force material within the tube 130 ahead of the peristaltic rollers 120 out of the tube 130 in the direction that the peristaltic rollers 120 are progressing.

In some embodiments, the distance between the peristaltic rollers 120, the width and/or diameters of the peristaltic rollers 120, and/or the number of peristaltic rollers may be varied. By changing one or more of these parameters, the amount of material pumped through the tube 130 for a give rotation of the centerless rim 105 may be varied. For example, if the centerless rim 105 is twenty inches in diameter and four peristaltic rollers 120 that are two inches in diameter and three-quarters of an inch wide, one rotation of the centerless rim 120 may pump approximately eight fluid ounces. As an additional example, if four fluid ounces were desired, eight rollers may be used. Additionally or alternatively, parameters of the tube 130 may also be varied, such as the diameter of the tube 130.

The tube 130 may include a flexible and compressible material with elastic properties such that the tube 130 may return to its original shape after being compressed by the peristaltic rollers 120. For example, the tube 130 may be made of a polytetrafluoroethylene (PTFE), polyvinyl chloride (PVC), silicone rubber, fluoropolymer, nitrile rubber (NBR), synthetic rubber, chlorosulfonated polyethylene synthetic rubber (CSM), silicone, ethylene propylene diene monomer (EPDM) rubber, EPDM+polypropylene, polyurethane, natural rubber, etc., or any combinations thereof. The tube housing 125 and/or the peristaltic rollers 120 may be sufficiently rigid to allow the tube 130 to be compressed between the tube housing 125 and the peristaltic rollers 120. In these and other embodiments, the tube housing 125 and/or the peristaltic rollers 120 may be made of a material and/or a finish that may provide a surface sufficiently smooth to prevent or avoid puncture of the tube 130. Additionally or alternatively, the finish of the tube housing 125 and/or the peristaltic rollers 120 may be selected to minimize or reduce wear on the tube 130. For example, the peristaltic rollers 120 may be a polyurethane or some other polymer material.

In some embodiments a centerless plate 140 may be coupled to the centerless rim 105, and the peristaltic rollers may be coupled to the centerless rim 105 via the centerless plate 140. For example, an axle 135 (e.g., the axles 135*a*-135*d*) may proceed through a peristaltic roller 120 and connect to the centerless plate 140 such that the peristaltic roller 120 may rotate freely about the axle 135. For example, the peristaltic roller 120 may be coupled to a face of the centerless plate 140 opposite the centerless rim. The face of the centerless plate 140 may include a protrusion or other feature to which the peristaltic roller 120 may be coupled. The axle 135 may include a bolt, rod, post, screw, or other connecting device. In some embodiments, the axle 135 may be utilized to couple the peristaltic roller 120 directly to the centerless rim 105, for example, without the centerless plate 140. In some embodiments, the centerless plate 140 may be approximately the same or a similar size and/or the same or a similar shape as the centerless rim 105 such that a void of material in the centerless rim 105 may be comparable in size and/or position to a void in material of the centerless plate 140. In these and other embodiments, because the peristaltic roller 120 is able to rotate around the axle 135 freely, static friction between the peristaltic roller 120 and the tube 130 may cause the peristaltic roller 120 to rotate about the axle 135 as it moves along the tube 130 during rotation of the centerless rim 105.

The centerless pump 100 may include a reservoir coupled to the tube 130. In some embodiments, the reservoir may be configured to hold a fluid material and may be coupled to the tube 130 such that the fluid material may be drawn through the tube 130 via operation of the centerless pump 100 (e.g., via rotation of the peristaltic rollers 120 with respect to the tube 130). The centerless pump 100 may include dispensing component coupled to an end of the tube 130 opposite an end of the tube 130 coupled to the reservoir. The dispensing component may include a nozzle or other component or device configured to facilitate dispensing of the material from the tube 130. For example, as the peristaltic rollers 120 compress the tube 130, negative pressure within the tube 130 may draw fluid from the reservoir into the tube 130. Additionally or alternatively, the peristaltic rollers 120 may force the fluid out of the tube 130 via the dispensing component.

The centerless pump 100 may be utilized in any of a variety of settings. For example, the centerless pump 100 may be utilized to dispense a fluid such as a consumer fluid that may include soap, lotion, shampoo, syrup, honey, etc. The centerless pump 100 may be utilized in medical circumstances, such as the delivery of intravenous fluids, dialysis, etc. In some embodiments, the centerless pump 100 may be advantageous because any fluid flowing through the tube 130 touches only the tube 130 and does not touch any other pump components (e.g., the peristaltic rollers 120, the first roller guide 110, or the centerless rim 105). Additionally or alternatively, the centerless pump 100 may be advantageous because a void is formed in the middle of the centerless pump 100 that may be used to store anything associated with the centerless pump 100, such as a reservoir of fluid, a motor, a battery, fuel, etc. Additionally, a gear reduction approach may be utilized to make a small, lightweight direct current (DC) motor viable as an alternative to conventional alternating current (AC) powered pumps. Such a feature may make the centerless pump 100 highly portable and easily powered by alternative sources of power such as solar power. The centerless pump 100 may be beneficial in field hospitals or other remote locations where AC power may be unavailable or unreliable and where continuous pumping may be important (e.g., dialysis machines at a field hospital or dialysis machines during transportation).

Modifications, additions, or omissions may be made to FIGS. 1A and 1B without departing from the scope of the present disclosure. For example, the centerless pump 100 may include more or fewer elements than those illustrated or described in the present disclosure. For example, the centerless pump 100 may include a reservoir, a motor, or a battery. As another example, the centerless pump 100 may include fewer than three roller guides, or fewer than four peristaltic rollers.

Figure 2:
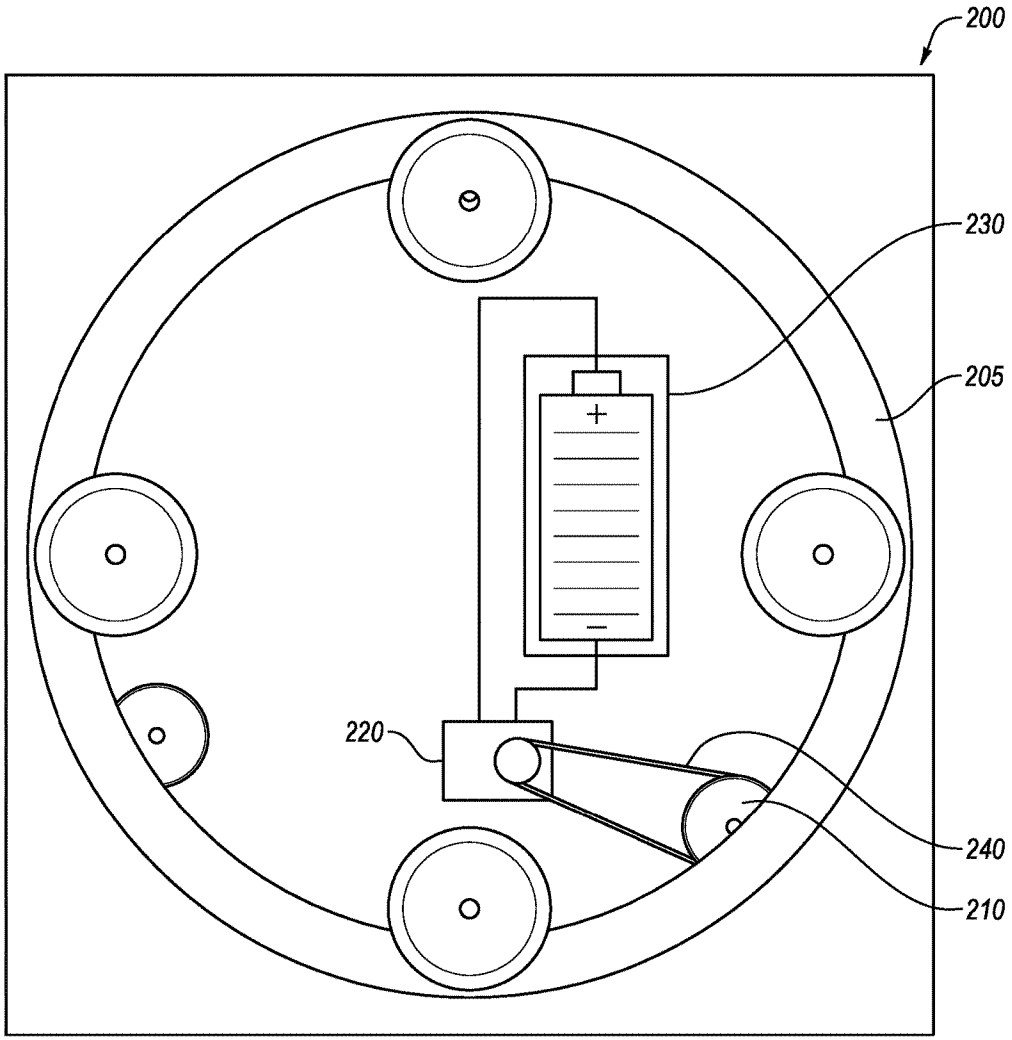
FIG. 2 illustrates a perspective view of an example centerless pump with a motor.

FIG. 2 illustrates a perspective view of an example centerless pump 200 with a motor 220, in accordance with one or more embodiments of the present disclosure. The centerless pump 200 may be similar or analogous to the centerless pump 100 of FIGS. 1A and 1B, and may include a centerless rim 205 (which may be similar or analogous to the centerless rim 105 of FIGS. 1A and 1B) and a first roller guide 210 (which may be similar or analogous to the first roller guide 110 of FIGS. 1A and 1B).

The motor 220 may be disposed in the void of the centerless rim 205, in some embodiments. The motor 220 may receive power from a power source 230 to drive the motor. In some embodiments, the motor 220 may be directly coupled to the first roller guide 210 (e.g., an output shaft of the motor 220 may be used as an axle that the first roller guide 210 is keyed to such that the output shaft and the first roller guide 210 move as a unitary body). Additionally or alternatively, a belt 240 or other mechanism may be coupled to the motor 220 and the first roller guide 210 to couple the motor 220 to the first roller guide 200 and to drive the first roller guide 210 when the motor rotates. For example, the motor 220 may include an output gear, output shaft, etc. that may interface with the belt 240. The belt 240 may be coupled, either directly or indirectly, to the first roller guide 210. For example, the first roller guide 210 may be keyed to an axle such that the axle and the first roller guide 210 move as a single body, and the axle may include a gear or portion that engages with the belt 240. Powering the motor 220 may thus rotate the belt 240, which may drive the first roller guide 210. Driving the first roller guide 210 may cause a corresponding rotation of the centerless rim 205 as the first roller guide 210 rolls along the centerless rim 205.

The motor 220 may include any device, system, or component configured to provide motive force to the first roller guide 210. For example, the motor 220 may include an electric motor such as a direct current (DC) motor, an alternating current (AC) motor, a brush motor, a brushless motor, a shunt wound motor, a separately excited motor, a series wound motor, a compound wound motor, a permanent magnet motor, a servomotor, an induction motor, a synchronous motor, a linear induction motor, a synchronous linear motor, etc. As another example, the motor 220 may include a fuel consuming engine, such as a four stroke engine, a diesel engine, a two stroke engine, a Wankel engine, an Atkinson engine, a gnome rotary engine, etc. In some embodiments, the motor 220 may include a small, high-speed, high-efficiency DC electric motor that may rotate at speeds greater than six thousand rotations per minute (RPM).

The power source 230 may include any device, system, or component configured to provide power or fuel to the motor 220. For example, the power source 230 may include a single-use battery (e.g., zinc-carbon or alkaline batteries), a rechargeable battery (e.g., a lead-acid battery, a nickel-cadmium battery, a lithium-ion battery, etc.), a solar cell, a fossil-fuel consuming generator, a reservoir of fuel (e.g., a reservoir of fossil fuel such as gasoline), a fuel-cell, etc., or any combinations thereof. The power source 230 may be coupled to the motor 220, such as electrically coupled or fluidically coupled.

Modifications, additions, or omissions may be made to FIG. 2 without departing from the scope of the present disclosure. For example, the centerless pump 200 may include more or fewer elements than those illustrated or described in the present disclosure. For example, the motor 220 may be directly coupled to the first roller guide 210. As another example, the centerless pump 200 may include fewer than three roller guides, or fewer than four peristaltic rollers.

Figure 3A:
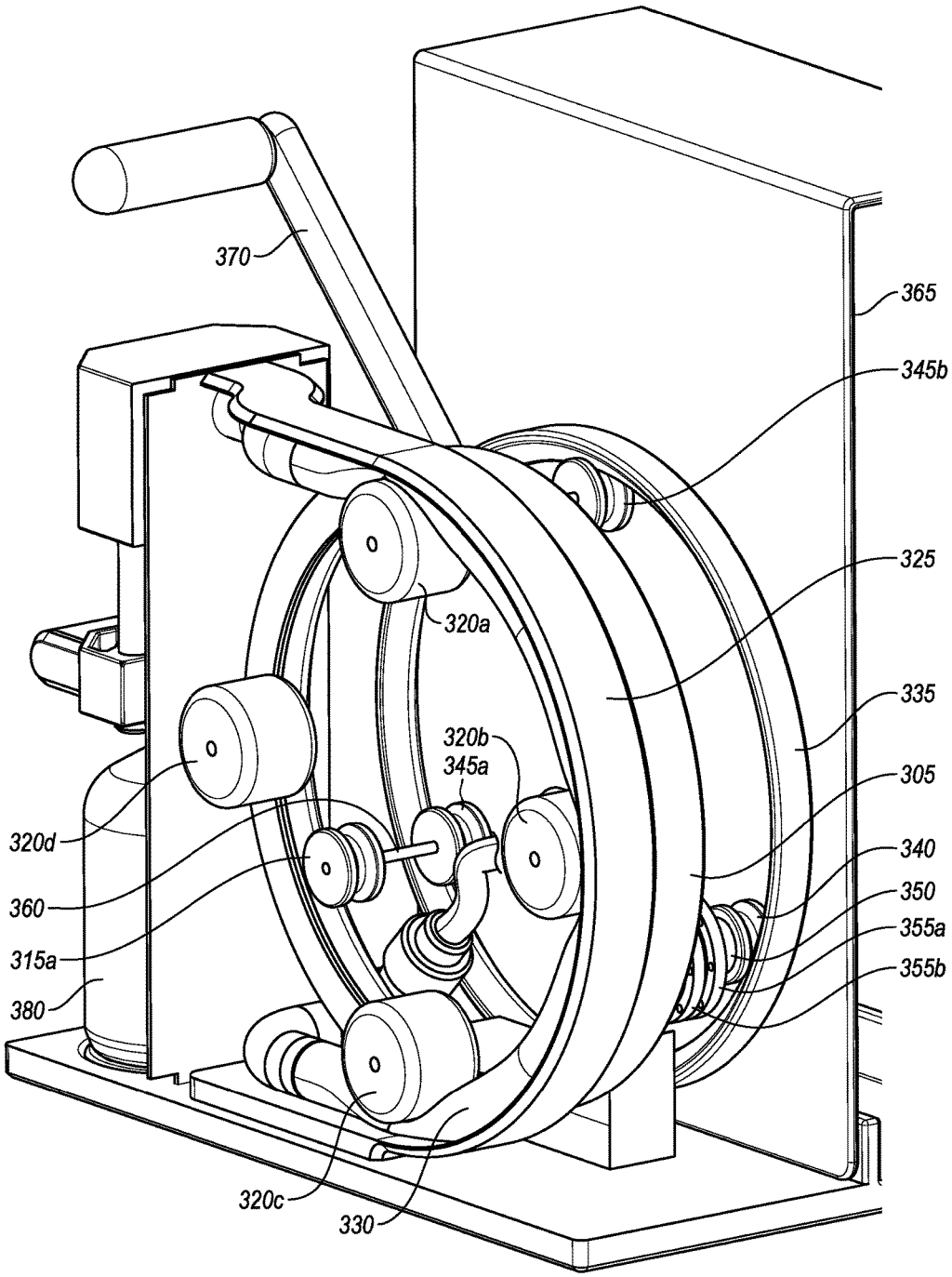
FIG. 3A illustrates a first perspective view of an example manual powered centerless pump.
Figure 3B:
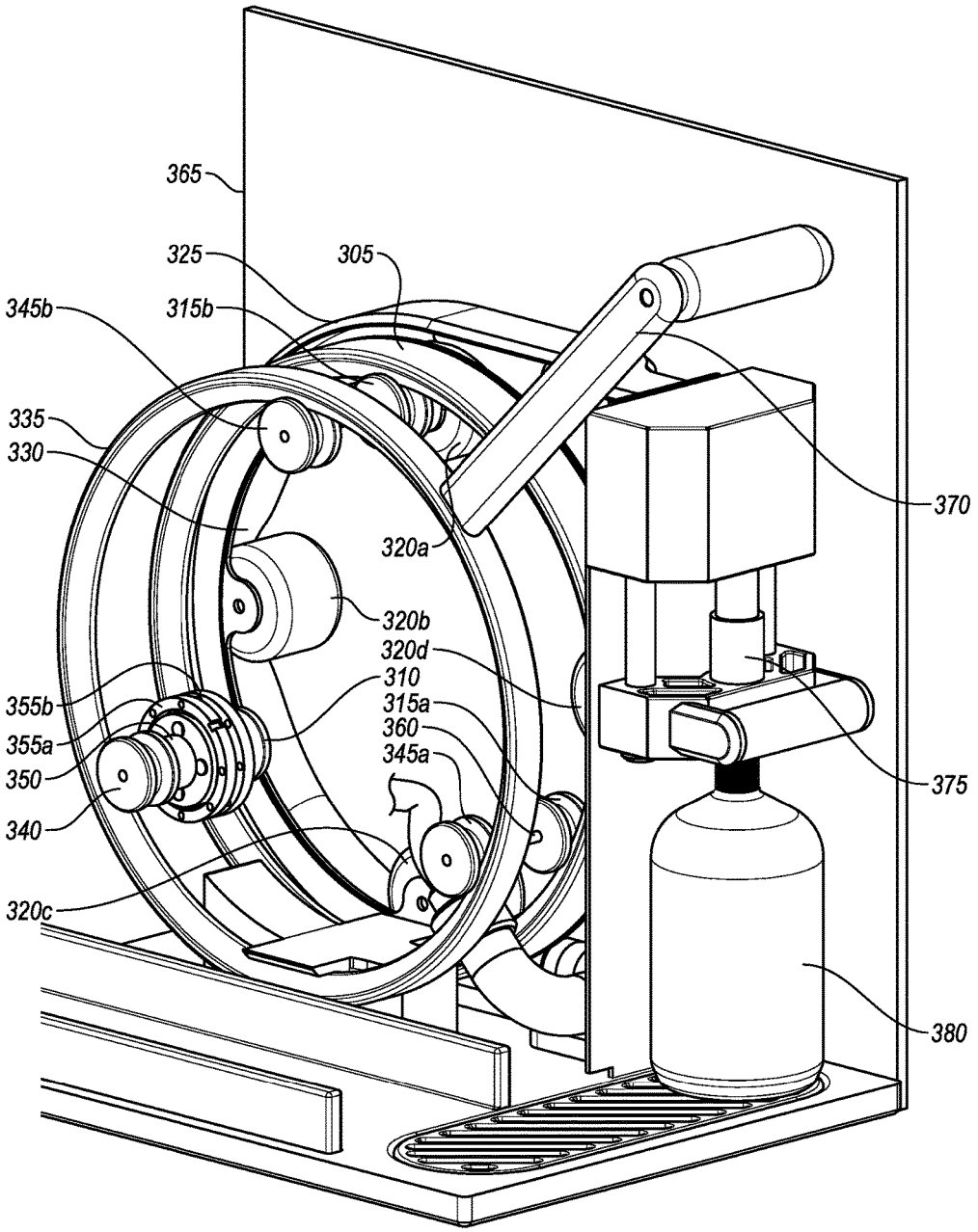
FIG. 3B illustrates a second perspective view of the example centerless pump of FIG. 3A.

FIGS. 3A and 3B illustrate a first and a second perspective view (respectively) of the same example manual powered centerless pump 300 viewed from the first and the second perspective views. The centerless pump 300 may be similar or analogous to the centerless pump 100 of FIGS. 1A and 1B. For example, the centerless pump 300 may include a first centerless rim 305 (which may be similar or analogous to the centerless rim 105 of FIGS. 1A and 1B), a first roller guide 310 (which may be similar or analogous to the first roller guide 110 of FIGS. 1A and 1B), second and third roller guides 315*a* and 315*b* (which may be similar or analogous to the second and third roller guides 115*a* and 115*b* of FIGS. 1A and 1B), peristaltic rollers 320*a*-320*d* (which may be similar or analogous to the peristaltic rollers 120*a*-120*d* of FIGS. 1A and 1B), a tube housing 325 (which may be similar or analogous to the tube housing 125 of FIGS. 1A and 1B), and a tube 330 (which may be similar or analogous to the tube 130 of FIGS. 1A and 1B).

The centerless pump 300 may include a second centerless rim 335, a fourth roller guide 340, and fifth and sixth roller guides 345*a* and 345*b*. The fourth roller guide 340 and the fifth and sixth roller guides 345*a* and 345*b* may be shaped and configured to roll along the second centerless rim 335. The second centerless rim 335 may be similar or analogous to the first centerless rim 305, such as the same or similarly sized and/or the same or similarly positioned with respect to an axis of rotation. For example, the second centerless rim 335 may be suspended by the fourth roller guide 340 and the fifth and sixth roller guides 345*a* and 345*b*. As the second centerless rim 335 is rotated, it may rotate about a center point of the second centerless rim 335 in a generally circular path defined by the fourth roller guide 340 and the fifth and sixth roller guides 345*a* and 345*b*. In some embodiments, the first centerless rim 305 is in a first plane and the second centerless rim 335 is in a second plane, and the first and the second planes may be generally parallel. Additionally or alternatively, the center point of the first centerless rim 305 may be in the first plane and the center point of the second centerless rim 335 may be in the second plane. In these and other embodiments, the center points of each of the first centerless rim 305 and the second centerless rim 335 may lie generally on a single line that is generally perpendicular to the first and the second planes. The single line may be the axis of rotation for the first centerless rim 305 and the second centerless rim 335. By using a generally common axis of rotation, a cylindrical-shaped void may be common to the first centerless rim 305 and the second centerless rim 335.

The first roller guide 310 may be mechanically coupled to the fourth roller guide 340. As illustrated in FIGS. 3A and 3B, a series of mechanical components may form the mechanical coupling between the first roller guide 310 and the fourth roller guide 340. For example, one-way bearings 350 may be part of the mechanical coupling between the first roller guide 310 and the fourth roller guide 340. The one-way bearings 350 may couple the first roller guide 310 and the fourth roller guide 340 such that as the fourth roller guide 340 rotates in one direction, the first roller guide 310 also rotates in that same direction, but as the fourth roller guide 340 rotates in the other direction, the first roller guide 310 is unaffected. For example, if facing the peristaltic rollers 320*a*-320*d*, rotation of the fourth roller guide 340 in a counter-clockwise direction may cause a corresponding counter-clockwise rotation of the first roller guide 310, while rotation of the fourth roller guide 340 in a clockwise direction may have no effect on the first roller guide 310.

Another example of a component that may form part of the mechanical coupling between the first roller guide 310 and the fourth roller guide 340 includes gears or gearboxes such as the first planetary gear 355*a* and the second planetary gear 355*b*. A planetary gear may be utilized to maintain the axis of rotation between the fourth roller guide 340 and the first roller guide 310 while gaining a mechanical advantage (or disadvantage). For example, if a target gearing ratio is 1:1 between rotations of the second centerless rim 335 and the first centerless rim 305, no planetary gears may be utilized. However, if a different gearing ratio may be targeted (e.g., 5:1 to 1:5, 1:1 to 1:5, 5:1 to 1:1, 1:1 to 1:3, or 1:1 to 1:1.5), one or more planetary gears may be utilized to accomplish the target gearing ratio.

In some embodiments, the pump 300 may include a pump housing 365. In these and other embodiments, one or more components of the mechanical coupling between the first roller guide 310 and the fourth roller guide 340 may be supported by the pump housing 365. For example, an axle common to the first roller guide 310 and the fourth roller guide 340 may be coupled to the pump housing 365. As another example, one or more of the planetary gears 355*a* and 355*b* may be supported by the pump housing 365. In these and other embodiments, an outer casing of the planetary gears or other gear box, or an annular gear of the planetary gears may be coupled to the pump housing 365. Supporting the mechanical coupling between the first roller guide 310 and the fourth roller guide 340 may in turn support the first roller guide 310 and/or the fourth roller guide 340. By supporting the first roller guide 310 and/or the fourth roller guide 340, the first roller guide 310 and the fourth roller guide 340 may rotate about a common single axis while otherwise remaining in a fixed position.

In some embodiments, the mechanical coupling between the first roller guide 310 and the fourth roller guide 340 may be a direct coupling. For example, a single axle may be shared between the first roller guide 310 and the fourth roller guide 340. In these and other embodiments, either of the first roller guide 310 and the fourth roller guide 340 may be keyed to the axle such that the roller guide and the axle move as a single body and the other may be coupled to the axle via one-way bearings or other similar ratcheting mechanism. Stated another way, a rotation in one direction of the fourth roller guide 340 may cause a corresponding and equal rotation of the first roller guide 310 in the same direction, but as the fourth roller guide 340 rotates in the other direction, the first roller guide 310 may be unaffected.

In some embodiments, a common axle 360 may be shared between the second roller guide 315*a* and the fifth roller guide 345*a*. In these and other embodiments, the common axle 360 may be generally parallel to the axis of rotation of the first centerless rim 305 and/or the second centerless rim 335. The common axle 360 may be fixedly coupled to a pump housing 365. For example, the pump housing 365 may function as an exoskeleton plate for the first centerless rim 305 and/or the second centerless rim 335. Stated another way, the pump housing 365 may support the common axle 360 such that the second roller guide 315*a* and the fifth roller guide 345*a* may rotate about the common axle 360 while otherwise remaining in a fixed position. In this way, the first centerless rim 305 and the second centerless rim 335 may rotate about their respective center points while rolling along the second roller guide 315*a* and the fifth roller guide 345*a*, respectively. In some embodiments, the second roller guide 315*a* and/or the fifth roller guide 345*a* may include bearings, lubrication, and/or other features to facilitate the rotation of the second roller guide 315*a* and/or the fifth roller guide 345*a* about the common axle 360. The common axle 360 may be coupled to the pump housing 365 on one side (e.g., the side proximate the second centerless rim 335) or on both sides. The third roller guide 315*b* and the sixth roller guide 345*b* may be supported by an analogous or similar common axle.

In some embodiments, one or more of the axles or support members for roller guides of the centerless pump 300 may be spring-loaded or otherwise biased towards a respective centerless rim. For example, the axle 360 may be disposed within a slot in the pump housing 365, the slot extending from the second centerless rim 335 and away from the second centerless rim 335. The axle 360 may be spring-loaded in the slot such that the second roller guide 315*a* provides an outward force against the second centerless rim 335. For example, the axle 360 may be spring-loaded to pull the second roller guide 315*a* towards the first centerless rim 305 and/or to pull the fifth roller guide 345*a* towards the second centerless rim 335. Using a spring or other biasing member may increase the friction between the roller guide and the respective centerless rim. Additionally or alternatively, using a spring or other biasing member may allow for removal of the centerless rim by compressing the roller guide against the spring or other biasing member to release the centerless rim from the roller guide. Such a biasing feature may be applicable to any embodiments of the present disclosure (e.g., that illustrated in FIGS. 1A/1B, 2, 4, and/or 5).

The centerless pump 300 may additionally include a lever arm 370, handle, ratchet arm, or other driving mechanism coupled to the second centerless rim 335. For example, the lever arm 370 may be welded, bolted, or otherwise directly coupled to the second centerless rim 335 at a position such as a ten o'clock position. Pulling the lever arm 370 may cause a corresponding rotation of the second centerless rim 335 about the center point of the second centerless rim 335. For example, if facing the peristaltic rollers 320*a-d* and analogizing the second centerless rim 335 to a clock face, if the lever arm 370 were coupled to the second centerless rim 335 at a ten o'clock position, the lever arm 370 may be manually pulled in a downward motion. As the lever arm 370 is pulled down, the second centerless rim 335 may rotate about the center point of the second centerless rim 335. The rotation of the second centerless rim 335 may in turn cause rotation of the fourth roller guide 340 as the fourth roller guide 340 rolls along the second centerless rim 335. The mechanical coupling between the fourth roller guide 340 and the first roller guide 310 may cause a corresponding rotation in the first roller guide 310 when the fourth roller guide 340 is rotated. Rotation of the first roller guide 310 may cause a corresponding rotation of the first centerless rim 305 about its center point as the first roller guide 310 rolls along the first centerless rim 305. Rotation of the first centerless rim 305 may cause the peristaltic rollers 320*a*-320*d* to roll along a generally circular path defined by the perimeter of the first centerless rim 305. As the peristaltic rollers 320*a*-320*d* trace the generally circular path, the tube 330 may be compressed against the tube housing 325, creating a negative pressure in the tube 330 behind the peristaltic rollers 320*a*-320*d*. Additionally or alternatively, any material in the tube 330 may be pushed out of the tube 330 by the peristaltic rollers 320*a*-320*d*.

Following the example of the lever arm 370 coupled to the second centerless rim 335 at a ten o'clock position, a stop or other feature may constrain how far downward the lever arm 370 may travel, in turn, constraining how far the second centerless rim 335 may rotate in a counter-clockwise direction. In some embodiments, the lever arm 370 may then be pushed upwards, or may be biased by a spring or other biasing member to return to a home position (e.g., the ten o'clock position). An additional stop or other feature may constrain how far upward the lever arm 370 may travel to return to the home position. As the second centerless rim 335 is rotated back in a clockwise direction when the lever arm 370 is returned to the home position, there may be a corresponding rotation of the fourth roller guide 340 in a clockwise direction. The mechanical coupling of the first roller guide 310 and the fourth roller guide 340 may prevent any corresponding rotation of the first roller guide 310 in a clockwise direction. For example, one way bearings or another ratchet-like mechanisms may be utilized to allow the first roller guide 310 to move freely when the fourth roller guide 340 turns in a clockwise direction, while engaging the fourth roller guide 340 with the first roller guide 310 as the fourth roller guide 340 turns in a counter-clockwise direction.

In some embodiments a first end of the tube 330 may be coupled to a reservoir of material. For example, the reservoir may contain a fluid material and may be disposed within the cylindrically shaped void in the middle of the first centerless rim 305 and the second centerless rim 335. In these and other embodiments, a nozzle 375 may be coupled to a second end of the tube 330 to facilitate dispensing of the material from the tube 330. For example, the nozzle 375 may take a shape or form to direct the exiting flow of material from the tube 330. In some embodiments, the nozzle 375 may be shaped and/or configured to allow for dispensing of the material from the tube 330 in a receiving container 380, such as a bottle.

Modifications, additions, or omissions may be made to FIGS. 3A and 3B without departing from the scope of the present disclosure. For example, the centerless pump 300 may include more or fewer elements than those illustrated or described in the present disclosure. For example, the centerless pump 300 may include a reservoir in the void in the middle of the pump 300. As another example, the centerless pump 300 may include fewer than three roller guides for either the first centerless rim 305 or the second centerless rim 335, or may include fewer than four peristaltic rollers.

Figure 4:
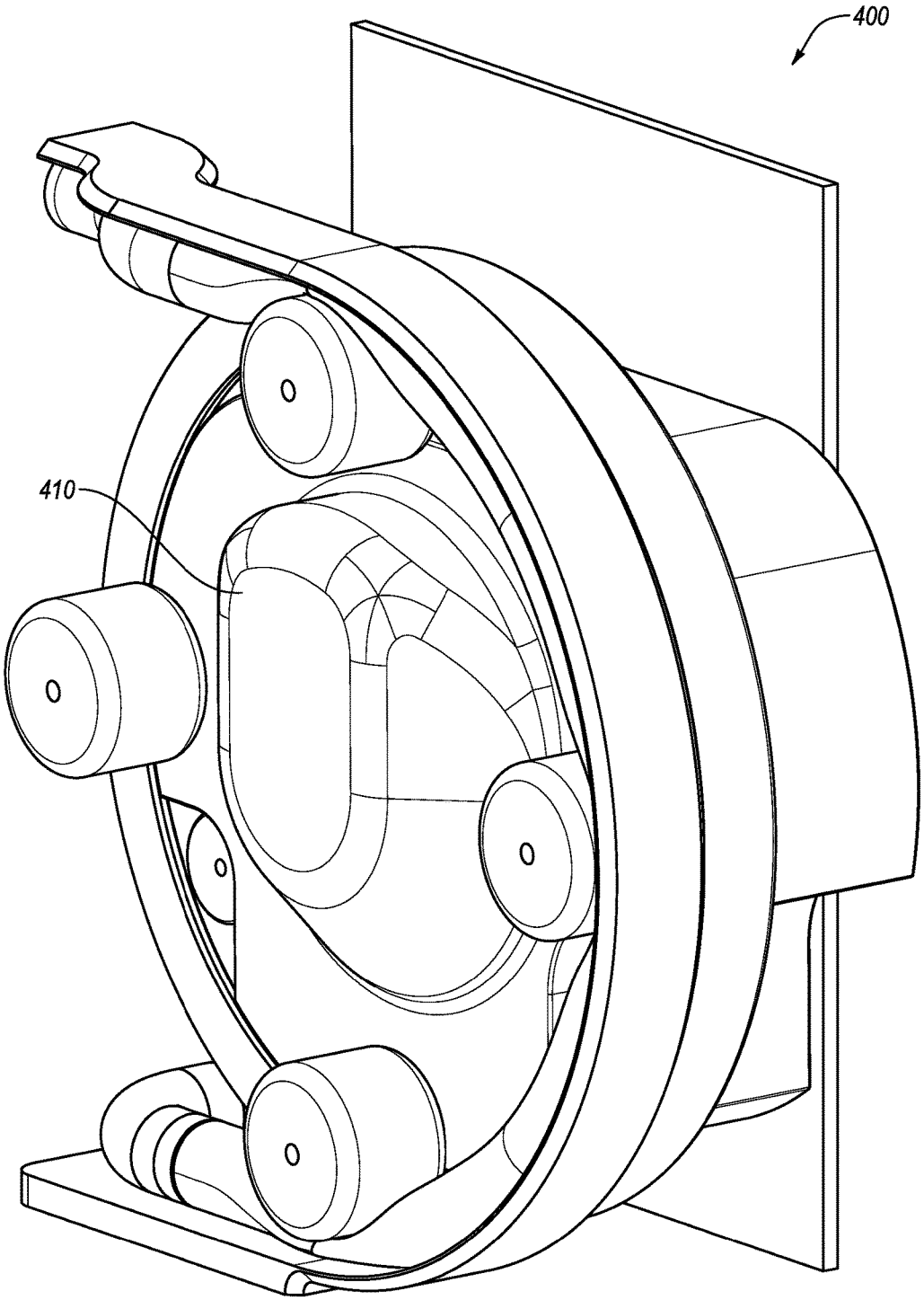
FIG. 4 illustrates a perspective view of an example centerless pump with a reservoir.

FIG. 4 illustrates a perspective view of an example centerless pump 400 with a reservoir 410, in accordance with one or more embodiments of the present disclosure. The centerless pump 400 may be analogous or similar to the centerless pump 100 of FIGS. 1A and 1B. The centerless pump 400 may include a void in the middle of the centerless pump. As illustrated in FIG. 4, a reservoir 410 of material may be stored in the void. Using the void, the centerless pump may maintain a smaller footprint than other traditional pumps. Such a space savings may be advantageous in settings in which space may be valuable, such as in a store, in a surgical suite, in a cargo aircraft (e.g., to resupply a field hospital), or in a space shuttle bay.

Modifications, additions, or omissions may be made to FIG. 4 without departing from the scope of the present disclosure. For example, the centerless pump 400 may include more or fewer elements than those illustrated or described in the present disclosure. For example, the centerless pump 400 may include fewer than three roller guides, or fewer than four peristaltic rollers.

Figure 5B:
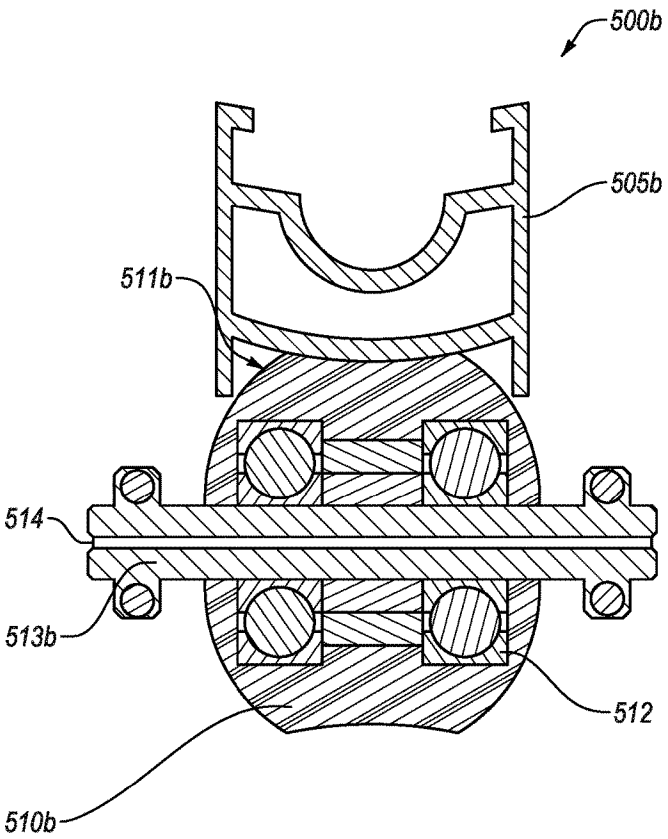
FIGS. 5A and 5B illustrate cross-sectional views of a portion of example pumps.
Figure 5A:
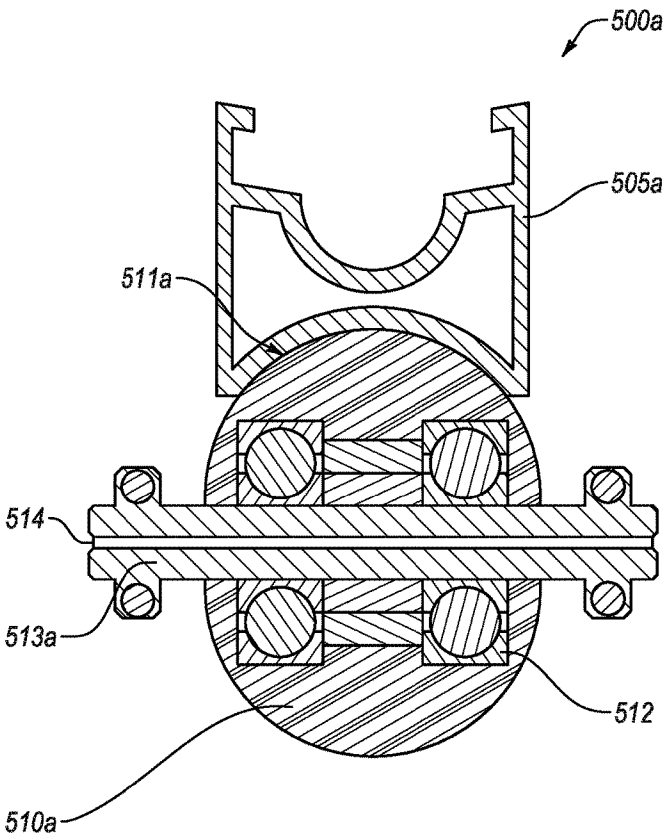

FIGS. 5A and 5B illustrate cross-sectional views of a portion of example pumps 500*a* and 500*b*, and the pumps 50*a* and 50*b* may illustrate example profiles and/or form factors for centerless rims (e.g., a concave centerless rim 505*a* in FIG. 5A and a convex centerless rim 505*b* in FIG. 5B) and roller guides (e.g., a convex roller guide 510*a* in FIG. 5A and a concave roller guide 510*b* in FIG. 5B).

In some embodiments, the first roller guides 510*a* and 510*b* may include a shape or profile that matches a corresponding shape or profile of the centerless rims 505*a* and 505*b*, respectively. For example, the first roller guide 510*a* may include a convex shape and the centerless rim 505*a* may include a concave shape, as illustrated in FIG. 6A. As another example, the first roller guide 510*b* may include a concave shape and the centerless rim 505*b* may include a convex shape, as illustrated in FIG. 5B. While the remaining description may be described with reference to FIG. 5A, the disclosure is equally applicable to FIG. 5B.

Static friction between the first roller guide 510*a* and the centerless rim 505*a* may drive the centerless rim 505*a* with minimal frictional losses and minimal scrubbing on an outer surface of first roller guide 510*a*. For example, because the shape and/or profile of the first roller guide 510*a* and the centerless rim 505*a* are generally matched, the surface area between the first roller guide 510*a* and the centerless rim 505*a* may be maximized, thus reducing slippage between the first roller guide 510*a* and the centerless rim 505*a*.

In some embodiments, a first roller guide assembly 511*a* may include first one-way bearings 512. In some embodiments, a first bridging driven shaft 513*a* may include a driven shaft with a key 514. The key 514 may lock the first roller guide 510*a* with the first bridging driven shaft 513*a* such that the first bridging driven shaft 513*a* and the first roller guide 510*a* move as a single body (e.g., when the first bridging driven shaft 513*a* rotates, the first roller guide 510*a* also rotates). Using the key 514, when the first bridging driven shaft 513*a* is rotated, static friction between the interior of the centerless rim 505*a* and the first roller guide 510*a* may rotate the centerless rim 505*a*. In some embodiments, the first roller guide 510*a* may function as an input gear and the interior of the centerless rim 505*a* may function as an output gear, thus, constituting a first stage of gear reduction. For example, the gear reduction may include a ratio of between approximately forty to one and two to one.

Modifications, additions, or omissions may be made to FIGS. 5A or 5B without departing from the scope of the present disclosure. For example, the pumps 500*a* and/or 500*b* may include more or fewer elements than those illustrated and described in the present disclosure. For example, the first roller guide 510*a* and/or the centerless rim 505*a* may take any shape, form or profile.

In various embodiments of the present disclosure, dimensions of the centerless pump may be modified or altered, depending on the application for which the centerless pump may be used. For example, the centerless pump may be very small in size (e.g., the centerless rim may be less than ten inches, less than five inches, or less than one inch in diameter) such that small volumes (e.g., milliliters or less) may be pumped. Additionally or alternatively, the centerless pump may be very large in size (e.g., the centerless rim may be tens of feet in diameter) such that large volumes (e.g., gallons, or tens of gallons) may be pumped.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," the term "containing" should be interpreted as "containing, but not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

All examples and conditional language recited in the present disclosure are intended for pedagogical objects to aid the reader in understanding the disclosure and the concepts contributed by the inventor to furthering the art, and are to be construed as being without limitation to such specifically recited examples and conditions. Although embodiments of the present disclosure have been described in detail, various changes, substitutions, and alterations could be made hereto without departing from the spirit and scope of the present disclosure.

What is claimed is:

1. A device comprising:

a centerless rim;

a driven roller guide configured to roll along the centerless rim and cause the centerless rim to rotate;

a peristaltic roller coupled to the centerless rim and configured to rotate with rotation of the centerless rim; and a tube disposed proximate the peristaltic roller such that as the centerless rim is rotated, the peristaltic roller compresses the tube.

2. The device of claim 1, wherein the driven roller guide is driven by a motor.

3. The device of claim 1, further comprising:

a second centerless rim generally parallel with the centerless rim; and a second roller guide configured to roll along the second centerless rim, the second roller guide sharing an axis of rotation with the driven roller guide.

4. The device of claim 1, further comprising one way bearings associated with the driven roller guide such that as an axle of the driven roller guide rotates in a first direction, the driven roller guide is also caused to rotate in the first direction, and as the axle rotates in a second direction, the driven roller guide continues to rotate in the first direction.

5. The device of claim 1, further comprising a centerless plate coupled to the centerless rim, the peristaltic roller coupled to the centerless rim via the centerless plate.

6. The device of claim 5, further comprising an axle for the peristaltic roller fixedly coupled to the centerless plate such that the peristaltic roller rotates freely about the axle.

7. The device of claim 1, further comprising a reservoir of fluid coupled with the tube such that as the peristaltic roller compresses the tube a negative pressure is generated in the tube to draw the fluid from the reservoir and into the tube.

8. The device of claim 7, wherein the fluid includes a consumer liquid comprising one of soap, lotion, shampoo, syrup, or honey.

9. The device of claim 7, further comprising a nozzle at a distal end of the tube to facilitate dispersal of the fluid from the tube.

10. The device of claim 1, further comprising a tube housing against which the tube is compressed by the peristaltic roller.

11. The device of claim 1, wherein the driven roller guide is biased towards the centerless rim.

12. The device of claim 11, further comprising a spring to bias the driven roller guide towards the centerless rim.

13. The device of claim 1, wherein a radius of the centerless rim compared to a radius of the driven roller guide has a ratio of between 5:1 and 1:1.

14. The device of claim 1, wherein the tube is made of a material selected to elastically deform such that after being compressed by the peristaltic roller, the tube returns to an original shape.

15. A device comprising:

a centerless rim;

a plurality of roller guides configured to roll along the centerless rim;

a peristaltic roller coupled to the centerless rim and configured to rotate with rotation of the centerless rim; and a tube disposed proximate the peristaltic roller such that as the centerless rim is rotated, the peristaltic roller compresses the tube.

16. The device of claim 15, further comprising a tube housing against which the tube is compressed by the peristaltic roller.

17. The device of claim 15, wherein at least one of the plurality of roller guides is driven by a motor.

18. A device comprising:

a centerless rim;

a roller guide configured to roll along the centerless rim;

a plurality of peristaltic rollers coupled to the centerless rim and configured to rotate with rotation of the centerless rim; and a tube disposed proximate the plurality of peristaltic rollers such that as the centerless rim is rotated, the plurality of peristaltic rollers compress the tube.

19. The device of claim 18, further comprising a tube housing against which the tube is compressed by the plurality of peristaltic rollers.

20. The device of claim 18 further comprising:

a second centerless rim generally parallel with the centerless rim; and a second roller guide configured to roll along the second centerless rim, the second roller guide sharing an axis of rotation with the roller guide.

* * * * *